US006764804B2

(12) United States Patent
Bourdelais et al.

(10) Patent No.: US 6,764,804 B2
(45) Date of Patent: Jul. 20, 2004

(54) ADHESIVE IMAGING MEMBER WITH COMPOSITE CARRIER SHEET

(75) Inventors: Robert P. Bourdelais, Pittsford, NY (US); Cheryl J. Kaminsky, Webster, NY (US); John M. Palmeri, Hamlin, NY (US); William Baum, Rochester, NY (US); Philip J. Smith, Webster, NY (US); Timothy J. Giarrusso, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/316,792

(22) Filed: Dec. 11, 2002

(65) Prior Publication Data

US 2004/0115557 A1 Jun. 17, 2004

(51) Int. Cl.[7] ..... G03C 1/765; G03C 1/795; G03C 1/805; B41J 3/407

(52) U.S. Cl. ..... 430/201; 430/259; 430/262; 430/263; 430/496; 430/533; 347/106

(58) Field of Search ..... 430/201, 259, 430/262, 263, 496, 533; 347/106

(56) References Cited

U.S. PATENT DOCUMENTS

| | | | | | |
|---|---|---|---|---|---|
| 4,777,067 | A | | 10/1988 | Woronow et al. | |
| 4,984,823 | A | | 1/1991 | Ishii et al. | |
| 5,292,154 | A | | 3/1994 | Williams | |
| 5,302,574 | A | | 4/1994 | Lawrence et al. | |
| 5,387,571 | A | | 2/1995 | Daly | |
| 5,507,166 | A | | 4/1996 | Orlick et al. | |
| 6,045,965 | A | | 4/2000 | Cournoyer et al. | 430/259 |
| 6,130,024 | A | * | 10/2000 | Aylward et al. | 430/263 |
| 6,132,942 | A | | 10/2000 | Woodworth et al. | |
| 6,153,367 | A | | 11/2000 | Gula et al. | |
| 6,270,950 | B1 | | 8/2001 | Bourdelais et al. | |
| 6,344,310 | B1 | | 2/2002 | Bourdelais et al. | |
| 6,436,604 | B1 | | 8/2002 | Bourdelais et al. | 430/263 |
| 6,531,258 | B1 | * | 3/2003 | Rieger et al. | 430/263 |
| 6,566,024 | B1 | * | 5/2003 | Bourdelais et al. | 430/263 |

* cited by examiner

*Primary Examiner*—Richard L. Schilling
(74) *Attorney, Agent, or Firm*—Paul A. Leipold

(57) ABSTRACT

The invention relates to an imaging element comprising a pragmatic imaging sheet comprising paper having a resin coat on each side, adhesively adhered to a carrier sheet with a pressure-sensitive adhesive, comprising at least one core layer of polyester and a rough lower surface layer.

26 Claims, No Drawings

ADHESIVE IMAGING MEMBER WITH COMPOSITE CARRIER SHEET

FIELD OF THE INVENTION

The invention relates to adhesive imaging materials. In a preferred form it relates to the use of silver halide pressure sensitive reflective media for the printing images that can be post processed laminated to display substrates.

BACKGROUND OF THE INVENTION

Prior art photographic albums typically require the consumer to manually insert conventional prints into a classic sleeve, or use adhesive to bond conventional prints to blank album pages. This is a time consuming, difficult operation that provides less than satisfactory results. Consumers often procrastinate and do not place prints in albums when they receive them from the photofinisher, risking loosing time and event references. When adhesives are used to maintain the prints in the album, alignment becomes critical. Additionally, many adhesives can damage a print and often fail after time, thus, allowing the prints to fall out of the album. Also, in addition to purchasing separate binder album pages, adhesive and other items may need to be purchased.

Professional photographic labs currently provide high quality images to the advertising and display industry for product advertising, point of purchase displays and trade show graphics. Presently, the lab print images using silver halide or ink jet imaging technology onto standard high quality paper and post printing laminate the images to substrates that provide structure to the image for display. The lamination of the image to the substrate typically occurs with a double sided pressure sensitive tape. It would be desirable if the use of the lamination tape could be eliminated to improve the efficiency of the work flow in the professional labs.

It is well known in the pressure sensitive adhesive industry to provide a pressure sensitive adhesive removability feature by carefully controlling the pressure sensitive adhesive coat weight within a certain range. While controlling the coat weight of the pressure sensitive adhesive does provide removability of the pressure sensitive adhesive for a period of time, the activation time for pressure adhesive with controlled coat weight varies considerably because of coat weight variation in the manufacturing operation. Repositioning pressure sensitive adhesive with controlled coat weight applied to image media would result in unpredictable repositioning time and ultimate bond strength for consumers and therefore would not be suitable for scrapbook and album applications were a predictable repositioning time and ultimate strength are required.

In U.S. Pat. No. 6,045,965, a photographic member with a peelable and repositioning adhesive member is discussed. While the adhesive discussed in U.S. Pat. No. 6,045,965 does reposition to a variety of surfaces, the adhesive formulations disclosed do not form permanent bonds between the photographic member and cellulose paper album pages. Therefore, the photographic member is not optimized for scrapbooks and albums were a permanent bond is valued. Further, the imaging member described in U.S. Pat. No. 6,045,965 disclose a thin, durable polymer sheet for repositioning an image. While the thin durable sheet does have high value for most consumer applications, lamination of the print to surfaces that are rough typically requires a base that is thick and strong to reduce the amount of image side embossing by rough lamination surfaces such as painted walls, cellulose paper board, fabric and flooring surfaces.

Typically pressure sensitive labels are supplied with a liner web material that allows the pressure sensitive label to be transported though the printing process and converting process while protecting the adhesive. Prior art liner materials typically comprise a coated paper or a thin polymer liner onto which a release coating is subsequently provided. Liner materials typically utilized in the pressure sensitive label are not suitable for a photographic images. Problems such as photographic reactivity with the light sensitive layers, lack of stiffness of the liner, and edge penetration of processing chemistry into the paper used as a liner prevent typical polymer and paper liners from being utilized for photographic pressure sensitive labels.

PROBLEM TO BE SOLVED BY THE INVENTION

There is a need for pressure sensitive imaging media that utilizes a liner material that can be efficiently conveyed through the image creation process while maintaining the quality of the image.

SUMMARY OF THE INVENTION

It is therefore an object of the present invention to provide an improved photograph and album system.

It is another object of the present invention to provide a base material that reduces the amount of image side embossing in lamination applications.

It is still yet another object of the present invention to provide a liner material that allows for efficient transport through printing and processing of images.

These and other objects of the invention are accomplished by an imaging element comprising an imaging layer, a pragmatic imaging sheet comprising paper having a resin coat on each side, adhesively adhered to a carrier sheet with a pressure-sensitive adhesive, wherein said carrier sheet comprises at least one core layer of polyester and a rough lower surface layer.

ADVANTAGEOUS EFFECT OF THE INVENTION

The invention provides improved image quality for imaging adhesive media materials. The invention also significantly reduces the amount of image side embossing caused by pressure sensitive lamination to rough surfaces.

DETAILED DESCRIPTION OF THE INVENTION

The invention has numerous advantages over prior practices in the art. The invention provides a photographic element that may be subjected to conventional photographic exposure and development processes and then peeled to form photographic elements that may be adhered to surfaces. These photographic elements may be in flexible sticker form. In another embodiment, the invention provides a method of incorporating means for dry mounting photographs to photograph albums. Further the photographs of the invention after peeling may be mounted to many non-traditional surfaces such as books, posters, school lockers, office walls, file cabinets and refrigerators. The materials if adhered to illuminated substrates such as lamp shades or windows may provide a illuminated image. Photographs of the invention may also be adhered back to back to form pages in a book, album or a technical report.

The invention reduces the amount of front side embossing as the imaging element is laminated to rough surfaces such as walls or rigid foam boards, when compared to polymer film base materials. The thickness and modulus of the imaging sheets provides sufficient thickness and compliance as to significantly reduce front side embossing of the imaging layers from rough surfaces. The invention further provides a tough carrier sheet that is removed prior to lamination of the imaging element. The tough carrier sheet is provided with the required roughness profile to allow for efficient transport though printing machines such as ink jet printers, thermal dye transfer printers and photographic printers. Further, the tough carrier sheet remains dimensionally stable during pressure sensitive lamination of the pragmatic sheet to the carrier sheet in manufacturing. Prior art carrier sheets that are thin typically suffer from shrinkage in the drying section of the pressure sensitive lamination machines.

Because the invention materials are thick, they can easily be handled by persons constructing photographic albums compared to prior art adhesive prints which comprise thin durable polymer film base imaging sheets. The thick pragmatic paper sheet also significantly reduces the amount of front side embossing the occurs when imaging elements are laminated to rough surfaces such as walls or cardboard. These and other advantages will be apparent from the detailed description below.

The terms as used herein, "top", "upper", "emulsion side", and "face" mean the side or toward the side of a photographic member bearing the imaging layers. The terms "bottom", "lower side", and "back" mean the side or toward the side of the photographic member opposite from the side bearing the photosensitive imaging layers or developed image. The term used herein "peelable adhesive" or "repositionable adhesive" means an adhesive material that has a peel strength less than 100 grams/cm. The term used herein "permanent adhesive" means as adhesive materials that has a peel strength of greater than 100 grams/cm. The term used herein "substrate" means materials that are commonly utilized in the advertising and display industry for the lamination of images. Examples include acrylic sheets, paper board, wall board, fabric, cardboard and polymer sheets.

In order to provide an imaging element that significantly reduces front side embossing caused by lamination to a rough surface and provide a web material that is efficiently transported thought printer equipment an imaging element comprising a pragmatic imaging sheet comprising paper having a resin coat on each side, adhesively adhered to a carrier sheet with a pressure-sensitive adhesive, comprising at least one core layer of polyester and a rough lower surface layer is preferred. By providing a carrier sheet comprising at least one layer of polyester, the carrier sheet is both tough and thin. The lower surface layer comprising a rough layer provides a rough surface for efficient conveyance through manufacturing, printing and processing. The polyester core of the preferred carrier sheet also provides dimensional stability during the manufacturing step of drying of the pressure sensitive adhesive. The pragmatic sheet of the invention comprising paper and polymer layers provides a thick sheet minimizing front side embossing caused by lamination to surfaces that are rough. Further, the paper utilized in the pragmatic sheet provides antistatic properties as it contains both salt and moisture.

The pragmatic imaging sheet suitably has a thickness of greater than 100 micrometers. The preferred thickness is between 400 and 500 micrometers to best provide the ability to be placed over a rough surface without showing the roughness in the print. The modulus of the pragmatic imaging sheet is suitably greater than 2000 MPa. The preferred modulus is between 2000 and 4000 MPa for good handling properties and the ability to conceal mounting surface roughness.

The resin coating on each side of the paper preferably comprises polyethylene. Polyethylene is low in cost, is easily extrudable thought extrusion slot dies and can contain inorganic chemistry useful in the formation of images. Examples of useful chemistry includes the use of white pigments such as $TiO_2$, barium sulfate, ZnO, calcium carbonate or optical brighteners. In another preferred embodiment of the invention, the resin coat on each side of the paper comprises polypropylene. Polypropylene is low in cost, can be processed thought a slit die and has a higher mechanical modulus than polyethylene resulting in a image element that is tougher and more tear resistant that polyethylene.

The rough back surface layer of the carrier sheet preferably comprises polyethylene. Polyethylene has been shown to replicate the surface of rough chilled roller and has the required coefficient of friction for transport in many silver halide printers, ink jet printers and thermal dye transfer printers. Further, polyethylene is soft and does not typically emboss subsequent image layers when the imaging element is wound into a roll for efficient printing.

The coefficient of friction or COF of the carrier sheet is an important characteristic as the COF is related to conveyance and forming efficiency in printing equipment. COF is the ratio of the weight of an item moving on a surface to the force that maintains contact between the surface and the item. The mathematical expression for COF is as follows:

$$COF=\mu=(\text{friction force/normal force})$$

The COF of the carrier sheet is measured using ASTM D-1894 utilizing a stainless steel sled to measure both the static and dynamic COF of the carrier. The preferred COF for the liner of the invention is between 0.2 and 0.6. The coefficient of static friction is the value at the time movement between the two surfaces is ready to start but no actual movement has occurred. The coefficient of kinetic friction refers to the case when the two surfaces are actually sliding against each other at a constant rate of speed. COF is usually measured by using a sled placed on the surface. The force necessary at the onset of sliding provides a measurement of static COF. Pulling the sled at a constant speed over a given length provides a measure of kinetic frictional force.

The back surface of the carrier sheet forming the back of the image element preferably has a roughness of between 0.18 and 0.6 micrometers. This range has been show to provide efficient transport through imaging printers and processors. Back surface roughness less than 0.15 micrometers has been shown to slip and loose registration. Surface roughness greater than 0.70 has been shown to emboss the imaging layers in a wound roll, especially, gelatin based silver halide imaging layers.

In a preferred embodiment, the surface roughness of the carrier sheet is in the form of a plurality of random microlenses, or lenslets. The microlenses have been shown to provide excellent conveyance through manufacturing and printing. The microlenses can also be easily heat embossed to provide branding on the imaging element without the use of expensive ink as the lenses very efficiently diffuse visible reflected light and create high contrast between thermally embossed areas and the lenses. The term "lenslet" means a small lens, but for the purposes of the present discussion, the terms lens and lenslet may be taken to be the same. The lenslets overlap to form complex lenses. "Complex lenses"

means a major lens having on the surface thereof multiple minor lenses. "Major lenses" mean larger lenslets in which the minor lenses are formed randomly on top of. "Minor lenses" mean lenses smaller than the major lenses that are formed on the major lens. The plurality of lenses of all different sizes and shapes are formed on top of one another to create a complex lens feature resembling a cauliflower. The lenslets and complex lenses formed by the lenslets can be concave into the transparent polymeric film or convex out of the transparent polymeric film. The term "concave" means curved like the surface of a sphere with the exterior surface of the sphere closest to the surface of the film. The term "convex" means curved like the surface of a sphere with the interior surface of the sphere closest to the surface of the film.

Preferably, the concave or convex lenses utilized to create the rough surface have an average frequency in any direction of between 4 and 250 complex lenses/mm. When a film has an average of 285 complex lenses/mm creates the width of the lenses approach the wavelength of light. The lenses will impart a color to the light passing through the lenses and change the color temperature of the display. Less than 4 lenses/mm Creates lenses that are too large and therefore diffuse the light less efficiently. Concave or convex lenses with an average frequency in any direction of between 22 and 66 complex lenses/mm are most preferred. The preferred rough surface has concave or convex lenses at an average width between 3 and 60 micrometers in the x and y direction. When lenses have sizes below 1 micrometer the lenses impart a color shift in the light passing through because the lenses dimensions are on the order of the wavelength of light. When the lenses have an average width in the x or y direction of more than 68 micrometers, the lenses is too large to diffuse the light efficiently. More preferred, the concave or convex lenses at an average width between 15 and 40 micrometers in the x and y direction The concave or convex complex lenses comprising minor lenses wherein the diameter of the smaller lenses is preferably less than 80%, on average, the diameter of the major lens. When the diameter of the minor lens exceeds 80% of the major lens, the diffusion efficiency is decreased because the complexity of the lenses is reduced. The concave or convex complex lenses comprising minor lenses wherein the width in the x and y direction of the smaller lenses is preferably between 2 and 20 micrometers. When minor lenses have sizes below 1 micron the lenses impart a color shift in the light passing through because the lenses dimensions are on the order of the wavelength of light. When the minor lenses have sizes above 25 micrometers, the diffusion efficiency is decreased because the complexity of the lenses is reduced. Most preferred are the minor lenses having a width in the x and y direction between 3 and 8 micrometers.

Preferably, the concave or convex complex lenses comprise an olefin repeating unit. Polyolefins are low in cost and easily formed on the surface of the carrier sheet. Further, polyolefin polymers are efficiently melt extrudable and therefore can be used to create an efficient rough surface on the imaging element.

The carrier sheet of the invention preferably has a stiffness between 15 and 30 millinewtons. Below 10 millinewtons, stripping of the carrier at time of lamination of the image to useful substrates such as paper board or acrylic board is difficult. A stiffness above 40 millinewtons is not cost justified. Further carrier materials typically discarded and a carrier stiffness between 15 and 30 millinewtons reduces the environmental impact of the discarded carrier. The carrier sheet of the invention has a thickness of between 50 and 100 micrometers. This preferred thickness range balances the ease of use with the environmental impact of discarded carrier sheet.

The carrier sheet of the invention preferably contains a release layer for the release of the pressure sensitive adhesive. Without the release layer the pressure sensitive adhesive would form a permanent bond between the carrier sheet and the pragmatic sheet. The release layer allows for uniform separation of the pressure sensitive adhesive at the pragmatic sheet carrier sheet interface. The release layer may be applied to the carrier sheet by any method known in the art for applying a release layer to substrates. Preferred examples include silicone coatings, tetrafluoroethylene fluorocarbon coatings, fluorinated ethylene-propylene coatings, and calcium stearate. Most preferred is a substantially cross linked silicone system that minimizes the unwanted interaction with photosensitive imaging layers. A substantially cross linked silicone system has greater than 98% crosslinking of the silicone. A cross linked silicone system that has a silver halide density stability of less than 0.03 is preferred as a density loss of less than 0.03 is below what customers can visually perceive. The density stability is measured by keeping an unexposed sample of light sensitive silver imaging layer applied to the surface of the pragmatic sheet containing the carrier sheet. The unexposed sample is kept at 30 degrees Celsius for 7 days at which time the sample is exposed with a test pattern containing density from 0.0 to 2.0. The sample is compared with a check material that is coated on inert polyester.

In a further embodiment of the invention, the core polyester layer is voided. The voided polyester sheet is high in opacity, has an increased mechanical modulus and temperature resistance compared to polyolefin voided materials and is dimensionally stable in dryers encountered in manufacturing and printing. According to the present invention a process useful for the production of a voided polymer core comprises a blend of particles of a linear polyester with from 10 to 40% by weight of particles of a homopolymer or copolymer of polyolefin, extruding the blend as a film, quenching and biaxially orienting the film by stretching it in mutually perpendicular directions, and heat setting the film. Preferred amount of polyolefin is between 40 and 50% of the total polymer weight of the vacuous layer as this gives a low cost and low density layer. The preferred polyolefin is propylene as it is low in cost and successfully blends with the polyester for extrusion.

The opacity of the resulting voided polymer core carrier sheet arises through voiding which occurs between the regions of the linear polyester and the polyolefin polymer during the stretching operation. The linear polyester component of the voided polymer core may consist of any thermoplastic film forming polyester which may be produced by condensing one or more dicarboxylic acids or a lower alkyl diester thereof, e.g. terephthalic acid, isophthalic, phthalic, 2,5-, 2,6- or 2,7-naphthalene dicarboxylic acid, succinic acid, sebacic acid, adipic acid, azelaic acid, bibenzoic acid, and hexahydroterephthalic acid, or bis-p-carboxy phenoxy ethane, with one or more glycols, e.g. ethylene glycol, 1,3-propanediol, 1-4-butanediol, neopentyl glycol and 1,4-cyclohexanedimethanol. It is to be understood that a copolyester of any of the above materials may be used. The preferred polyester is polyethylene terephthalate.

The preferred polyolefin. additive which is blended with the polyester is a homopolymer or copolymer of propylene. Generally a homopolymer produces adequate opacity in the vacuous polymer and it is preferred to use homopolypropylene. An amount 10 to 40% by weight of polyolefin additive, based on the total weight of the blend, is used. Amounts less than 10% by weight do not produce an adequate opacifying effect. Increasing the amount of polyolefin additive causes the tensile properties, such as tensile yield and break strength, modulus and elongation to break, to deteriorate and it has been found that amounts generally exceeding about 40% by weight can lead to film splitting during production. Satisfactory opacifying and tensile properties can be obtained with up to 35% by weight of polyolefin additive.

The polyolefin additive preferably used in the carrier sheet of this invention is incompatible with the polyester component of the vacuous polymer base and exists in the form of discrete globules dispersed throughout the oriented and heat set vacuous polymer base. The opacity of the vacuous polymer base is produced by voiding which occurs between the additive globules and the polyester when the vacuous polymer base is stretched. It has been discovered that the polymeric additive must be blended with the linear polyester prior to extrusion through the film forming die by a process which results in a loosely blended mixture and does not develop an intimate bond between the polyester and the polyolefin additive.

Such a blending operation preserves the incompatibility of the components and leads to voiding when the vacuous polymer base is stretched. A process of dry blending the polyester and polyolefin additive has been found to be useful. For instance, blending may be accomplished by mixing finely divided, e.g. powdered or granufar, polyester and polymeric additive and, thoroughly mixing them together, e.g. by tumbling them. The resulting mixture is then fed to the film forming extruder. Blended polyester and polymeric additive which has been extruded and, e.g. reduced to a granulated form, can be successfully re-extruded into a vacuous opaque voided film (vacuous polymer base). It is thus possible to re-feed scrap film, e.g. as edge trimmings, through the process. Alternatively, blending may be effected by combining melt streams of polyester and the polyolefin additive just prior to extrusion. If the polymeric additive is added to the polymerization vessel in which the linear polyester is produced, it has been found that voiding and hence opacity is not developed during stretching. This is thought to be on account of some form of chemical or physical bonding which may arise between the additive and polyester during thermal processing.

The extrusion, quenching and stretching of the voided polymer core may be effected by any process which is known in the art for producing oriented polyester film, e.g. by a flat film process or a bubble or tubular process. The flat film process is preferred for making vacuous polymer base according to this invention and involves extruding the blend through a slit die and rapidly quenching the extruded web upon a chilled casting drum so that the polyester component of the film is quenched into the amorphous state. The film base is then biaxially oriented by stretching in mutually perpendicular directions at a temperature above the glass-rubber transition temperature of the polyester. Generally the film is stretched in one direction first and then in the second direction although stretching may be effected in both directions simultaneously if desired. In a typical process the film is stretched firstly in the direction of extrusion over a set of rotating rollers or between two pairs of nip rollers and is then stretched in the direction transverse thereto by means of a tenter apparatus. The film may be stretched in each direction to 2.5 to 4.5 times its original dimension in the direction of stretching. After the film has been stretched and a vacuous polymer base formed, it is heat set by heating to a temperature sufficient to crystallize the polyester whilst restraining the vacuous polymer base against retraction in both directions of stretching. The voiding tends to collapse as the heat setting temperature is increased and the degree of collapse increases as the temperature increases. Hence the light transmission increases with an increase in heat setting temperatures. Whilst heat setting temperatures up to about 230 C. can be used without destroying the voids, temperatures below 200 C. generally result in a greater degree of voiding and higher opacity.

The opacity as determined by the total luminous transmission of a voided polymer core depends upon the thickness of the voided polymer core. Thus the stretched and heat set voided polymer core made according to this invention have a total luminous transmission not exceeding 25%, preferably not exceeding 20%, for vacuous polymer base having a thickness of at least 100 micrometers, when measured by ASTM test method D-1003-61. Voided polymer core of thickness 50 to 99 micrometers have a total luminous transmission generally up to 30%. The invention also therefore relates to opaque biaxially oriented and heat set vacuous polymer bases produced from a blend of a linear polyester and from 10 to 40% by weight of a homopolymer or copolymer of ethylene or propylene and having a total luminous transmission of up to 30%. Such vacuous polymer bases may be made by the process specified above. The globules of polymeric additive distributed throughout the film produced according to this invention are generally 5 to 50 micrometer in diameter and the voids surrounding the globules 3 to 4 times the actual diameter of the globules. It has been found that the voiding tends to collapse when the void size is of the order of the vacuous polymer base thickness. Such vacuous polymer base therefore tends to exhibit poor opacity because of the smaller number of void surfaces at which light scattering can occur. Accordingly it is therefore preferred that the voided polymer core of this invention should have a thickness of at least 25 microns. Voided polymer core thickness of between 100 and 250 micrometers are convenient for most end uses. Because of the voiding, the voided polymer core with a density of less than 0.7 gm/cc lighter in weight, and more resilient than those bases with higher densities. The voided polymer core may contain any compatible additive, such as pigments. Thus a light reflecting pigment, such as titanium dioxide, may be incorporated to improve the appearance and whiteness of the voided polymer core.

Minimizing the curl of the carrier sheet is critical to the performance of the imaging element during printing, processing and lamination as curl can lead to jamming in printers. The carrier sheet of the invention preferably has a curl of less than 15 units. Curl is minimized, in a preferred embodiment, by placing a polyethylene layer on each side of the polyester sheet. The curl test measures the amount of curl in a parabolically deformed sample. A 8.5 cm diameter round sample of the composite was stored at the test humidity for 21 days. The amount of time required depends on the vapor barrier properties of the laminates applied to the moisture sensitive paper base, and it should be adjusted as necessary by determining the time to equilibrate the weight of the sample in the test humidity. The curl readings are expressed in ANSI curl units, specifically, 100 divided by the radius of curvature in inches. The radius of curvature is determined by mounting the sample perpendicular to the measurement surface, visually comparing the curled shape, sighting along the axis of curl, with standard curves in the background. The standard deviation of the test is 2 curl units.

The curl may be positive or negative, and for photographic products, the usual convention is that the positive direction is curling towards the photosensitive or imaging layer.

A pressure sensitive imaging element adhesive is utilized in the invention to allow the printed or developed silver halide image to be adhered to the surface of the substrates that are typically utilized in the advertising and display market. "Peelable separation" or "peel strength" or "separation force" is a measure of the amount of force required to separate two surfaces that are held together by internal forces of the pressure sensitive adhesive which consist of valence forces or interlocking action, or both. Peel strength is measured using an Instron gauge and peeling the sample at 180 degrees with a crosshead speed of 1.0 meters/min. The sample width is 5 cm and the distance peeled is 10 cm in length.

A peelable pressure sensitve adhesive is utilized to allow the consumer to separate the imaging element from a display substrate. Separation of the pragmatic sheet containing the imaging element would allow, for example, an image to be repositioned to a wall or column for a trade show and then moved to a new location. The preferred peel strength between the pragmatic sheet and a substrate is no greater than 80 grams/cm. A peel strength greater than 100 grams/cm, consumers would begin to have difficulty separating the image from a substrate. Further, at peel strengths greater than 110 grams/cm, the force is beginning to approach the internal strength of paper substrate, causing an unwanted fracture of the paper substrate before the separation of the image.

In another embodiment of the invention, upon separation of the pragmatic sheet from the carrier sheet, the peelable pressure sensitive adhesive of this invention has a preferred repositioning peel strength between 20 grams/cm and 100 grams/cm. Repositioning peel strength is the amount of force required to peel the separated image containing an pressure sensitive adhesive from a stainless steel block at 23° C., and 50% RH. At repositioning peel strengths less than 15 grams/cm, the pressure sensitive adhesive lacks sufficient peel strength to remain adhered to a variety of surfaces such as refrigerators or photo albums. At peel strengths greater than 120 grams/cm, the pressure sensitive adhesive of this invention is too aggressive, not allowing the consumer to later reposition the image.

In a further embodiment of the invention, the pressure sensitive adhesive has a peel strength greater than 150 grams per 5 centimeters. Peel strengths greater than 150 grams provide a permanent bond between the pragmatic sheet containing the imaging layers and various substrates utilized in the display and advertising market. Further, for gelatin based photographic imaging elements, the peel force greater than 150 grams resists the curling forces caused by the shrinking of the gelatin binder used for silver halide imaging systems.

The pressure sensitive adhesive of this invention may be a single layer or two or more layers. Suitable peelable pressure sensitive adhesives of this invention must not interact with the light sensitive silver halide imaging system so that image quality is deteriorated. Further, since photographic elements of this invention must be photoprocessed, the performance of the pressure sensitive adhesive of this invention must not be deteriorated by photographic processing chemicals. Suitable pressure sensitive adhesive may be inorganic or organic, natural or synthetic, that is capable of bonding the image to the desired surface by surface attachment. Examples of inorganic pressure sensitive adhesives are soluble silicates, ceramic and thermosetting powdered glass. Organic pressure sensitive adhesives may be natural or synthetic. Examples of natural organic pressure sensitive adhesives include bone glue, soybean starch cellulosics, rubber latex, gums, terpene, mucilages and hydrocarbon resins. Examples of synthetic organic pressure sensitive adhesives include elastomer solvents, polysulfide sealants, theromplastic resins such as isobutylene and polyvinyl acetate, theromsetting resins such as epoxy, phenoformaldehyde, polyvinyl butyral and cyanoacrylates and silicone polymers.

For single or multiple layer pressure sensitive adhesive systems, the preferred pressure sensitive adhesive composition is selected from the group consisting of natural rubber, syntheic rubber, acrylics, acrylic copolymers, vinyl polymers, vinyl acetate-, urethane, acrylate- type materials, copolymer mixtures of vinyl chloride-vinyl acetate, polyvinylidene, vinyl acetate-acrylic acid copolymers, styrene butadiene, carboxylated stryrene butadiene copolymers, ethylene copolymers, polyvinyl alcohol, polyesters and copolymers, cellulosic and modified cellulosic, starch and modified starch compounds, epoxies, polyisocyanate, polyimides.

Water based pressure sensitive adhesion provide some advantages for the manufacturing process of non solvent emissions. Repositionable peelable pressure sensitive adhesive containing non-pressure sensitive adhesive solid particles randomly distributed in the pressure sensitive adhesive layer aids in the ability to stick and then remove the print to get the desired end result. The most preferred pressure sensitive peelable pressure sensitive adhesive is a respositionable pressure sensitive adhesive layer containing at about 5% to 20% by weight of a permanent pressure sensitive adhesive such as isooctyl acrylate/acrylic acid copolymer and at about 95% to 80% by weight of a tacky elastomeric material such as acrylate microspheres with the pressure sensitive adhesive layer coverage at about 5 to 20 $g/m^2$.

The preferred peelable pressure sensitive adhesive materials may be applied using a variety of methods known in the art to produce thin, consistent pressure sensitive adhesive coatings. Examples include gravure coating, rod coating, reverse roll coating, and hopper coating. The pressure sensitive adhesives may be coated on the liner or the face stock materials prior to lamination. For single or multiple layer pressure sensitive adhesive systems, the preferred permanent pressure sensitive adhesive composition is selected from the group consisting of epoxy, phenoformaldehyde, polyvinyl butyral, cyanoacrylates, rubber based pressure sensitive adhesives, styrene/butadiene based pressure sensitive adhesives, acrylics and vinyl derivatives.

The pressure sensitive adhesives of the invention preferably contain a pigment. Pigments are well known to add color or whiteness. The addition of white pigments such as $TiO_2$ or ZnO improve the opacity of the pragmatic sheet containing the imaging elements when applied to the various display substrates. Foe example, a wedding scene applied to a dark wall would suffer in quality if the adhesive was not pigmented white as the wedding dress on the bride would appear dark and low in quality. Colored pigments are preferably added to the pressure sensitive adhesive of the invention to build brand awareness and allow for better contrast when the imaging elements are laminated to display substrates.

Antioxidants are preferably added to the adhesive layer to reduce the amount of oxidation in the adhesive layer which results in a loss of pressure sensitive adhesive properties such as peel force and shear resistance. The antioxidant addition is particularly important as the invention materials are dryed in heated dryers in several points during manufacturing and printing. The antioxidants help maintain the desirable strength and adhesion properties of the adhesive.

Since the light sensitive silver halide layers of a preferred embodiment of the invention can suffer from unwanted exposure from static discharge during manufacturing, printing and processing, the pressure sensitive adhesive preferably has a resistivity of less than $10^{11}$ ohms/square. A wide variety of electrically-conductive materials can be incorporated into adhesive layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc. have been described previously. However, these antistatic layers typically contain a high volume percentage of electronically conducting materials which are often expensive and impart unfavorable physical characteristics, such as color, increased brittleness, and poor adhesion to the antistatic layer.

In a preferred embodiment of this invention the label has an antistat material incorporated into the liner or in the adhesive layer. It is desirable to have an antistat that has an electrical surface resistivity of at least $10^{11}$ log ohms/square. In the most preferred embodiment, the antistat material comprises at least one material selected from the group consisting of tin oxide and vanadium pentoxide.

In another preferred embodiment of the invention antistatic material are incorporated into the pressure sensitive adhesive layers. The antistatic material incorporated into the pressure sensitive adhesive layer provides static protection to the silver halide layers and reduces the static on the label which has been shown to aid labeling of containers in high speed labeling equipment. As a stand-alone or supplement to the carrier comprising an antistatic layer, the pressure sensitive adhesive may also further comprise an antistatic agent selected from the group consisting of conductive metal oxides, carbon particles, and synthetic smectite clay, or multilayered with an inherently conductive polymer. In one of the preferred embodiments, the antistat material is metal oxides. Metal oxides are preferred because they are readily dispersed in the thermoplastic adhesive :and can be applied to the polymer sheet by any means known in the art. Conductive metal oxides that may be useful in this invention are selected from the group consisting of conductive particles including doped-metal oxides, metal oxides containing oxygen deficiencies, metal antimonates, conductive nitrides, carbides, or borides, for example, $TiO_2$, $SnO_2$, $Al._2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC. The most preferred materials are tin oxide and vanadium pentoxide because they provide excellent conductivity and are transparent.

Used herein, the phrase 'imaging element' comprises an imaging support comprising the pragmatic sheet, pressure sensitive adhesive and the carrier sheet as described above, along with an imaging layer as applicable to multiple techniques governing the transfer of an image onto the imaging element. Such techniques include thermal dye transfer, electrophotographic printing, or ink jet printing, as well as a support for photographic silver halide images. As used herein, the phrase "photographic element" is a material that utilizes photosensitive silver halide in the formation of images.

The thermal dye image-receiving layer of the imaging elements for thermal dye transfer of the invention may comprise polymers or mixtures of polymers that provide sufficient dye density, printing efficiency and high quality images. For example, polycarbonate, polyurethane, polyester, polyvinyl chloride, poly(styrene-co-acrylonitrile), poly(caprolactone), polylatic acid, saturated polyester resins, polyacrylate resins, poly(vinyl chloride-co-vinylidene chloride), chlorinated polypropylene, poly(vinyl chloride-co-vinyl acetate), poly(vinyl chloride-co-vinyl acetate-co-maleic anhydride), ethyl cellulose, nitrocellulose, poly(acrylic acid)esters, linseed oil-modified alkyd resins, rosin-modified alkyd resins, phenol-modified alkyd resins, phenolic resins, maleic acid resins, vinyl polymers, such as polystyrene and polyvinyltoluene or copolymer of vinyl polymers with methacrylates or acrylates, poly (tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly (methyl methacrylate). Among them, a mixture of a polyester resin and a vinyl chloridevinyl acetate copolymer is preferred, with the mixing ratio of the polyester resin and the vinyl chloride-vinyl acetate copolymer being preferably 50 to 200 parts by weight per 100 parts by weight of the polyester resin. By use of a mixture of a polyester resin and a vinyl chloride-vinyl acetate copolymer, light resistance of the image formed by transfer on the image-receiving layer can be improved.

The dye image-receiving layer may be present in any amount that is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

In another embodiment of the invention, the thermal dye receiving layer comprises a polyester. Polyesters are low in cost and have good strength and surface properties. Polyesters have high optical transmission values that allow for high light transmission and diffusion. This high light transmission and diffusion allows for greater differences in the bright and dark projected areas increasing contrast. In a preferred embodiment of the invention, the polyesters have a number molecular weight of from about 5,000 to about 250,000 more preferably from 10,000 to 100,000.

The polymers used in the dye-receiving elements of one embodiment of the invention are condensation type polyesters based upon recurring units derived from alicyclic dibasic acids (Q) and diols (L) wherein (Q) represents one or more alicyclic ring containing dicarboxylic acid units with each carboxyl group within two carbon atoms of (preferably immediately adjacent) the alicyclic ring and (L) represents one or more diol units each containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more C1 to C4 alkyl groups. Each of the diols may also optionally be substituted on the aromatic or alicyclic ring, e.g. by C1 to C6 alkyl, alkoxy, or halogen.

In another embodiment of the invention, the thermal dye receiving layer comprises a polycarbonate. The diffusion elements formed out of polycarbonate are easily melted to form areas of specular and diffuse transmission. Polycarbonates have high optical transmission values that allow for high light transmission and diffusion. This high light transmission and diffusion allows for greater differences in the bright and dark projected areas increasing contrast.

Polycarbonates (the term "polycarbonate" as used herein means a carbonic acid and a diol or diphenol) and polyesters have been suggested for use in image-receiving layers. Polycarbonates (such as those disclosed in U.S. Pat. Nos. 4,740,497 and 4,927,803) have been found to possess good dye uptake properties and desirable low fade properties when used for thermal dye transfer. As set forth in U.S. Pat. No. 4,695,286, bisphenol-A polycarbonates of number average molecular weights of at least about 25,000 have been found to be especially desirable in that they also minimize surface deformation that may occur during thermal printing.

Polyesters, on the other hand, can be readily synthesized and processed by melt condensation using no solvents and relatively innocuous chemical starting materials. Polyesters formed from aromatic diesters (such as disclosed in U.S. Pat. No. 4,897,377) generally have good dye up-take properties when used for thermal dye transfer. Polyesters formed from alicyclic diesters disclosed in U.S. Pat. No. 5,387,571 (Daly et al.) and polyester and polycarbonate blends disclosed in U.S. Pat. No. 5,302,574 (Lawrence et al.), the disclosure of which is incorporated by reference.

Polymers may be blended for use in the dye-receiving layer in order to obtain the advantages of the individual polymers and optimize the combined effects. For example, relatively inexpensive unmodified bisphenol-A polycarbonates of the type described in U.S. Pat. No. 4,695,286 may be blended with the modified polycarbonates of the type described in U.S. Pat. No. 4,927,803 in order to obtain a receiving layer of intermediate cost having both improved resistance to surface deformation which may occur during thermal printing and to light fading which may occur after printing. A problem with such polymer blends, however, results if the polymers are not completely miscible with each other, as such blends may exhibit a certain amount of haze. While haze is generally undesirable, it is especially detrimental for transparent labels. Blends that are not completely compatible may also result in variable dye uptake, poorer image stability, and variable sticking to dye donors.

In a preferred embodiment of the invention, the alicyclic rings of the dicarboxylic acid derived units and diol derived units contain from 4 to 10 ring carbon atoms. In a particularly preferred embodiment, the alicyclic rings contain 6 ring carbon atoms.

A dye-receiving element for thermal dye transfer comprising a miscible blend of an unmodified bisphenol-A polycarbonate having a number molecular weight of at least about 25,000 and a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring are preferred. This polymer blend has excellent dye uptake and image dye stability, and which is essentially free from haze. It provides a receiver having improved fingerprint resistance and retransfer resistance, and can be effectively printed in a thermal printer with significantly reduced thermal head pressures and printing line times. Surprisingly, these alicyclic polyesters were found to be compatible with high molecular weight polycarbonates.

Examples of unmodified bisphenol-A polycarbonates having a number molecular weight of at least about 25,000 include those disclosed in U.S. Pat. No. 4,695,286. Specific examples include Makrolon 5700 (Bayer AG) and LEXAN 141 (General Electric Co.) polycarbonates.

In a further preferred embodiment of the invention, the unmodified bisphenol-A polycarbonate and the polyester polymers are blended at a weight ratio to produce the desired Tg of the final blend and to minimize cost. Conveniently, the polycarbonate and polyester polymers may be blended at a weight ratio of from about 75:25 to 25:75, more preferably from about 60:40 to about 40:60.

Among the necessary features of the polyesters for the blends of the invention is that they do not contain an aromatic diester such as terephthalate, and that they be compatible with the polycarbonate at the composition mixtures of interest. The polyester preferably has a Tg of from about 40 C. to about 100 C., and the polycarbonate a Tg of from about 100 C. to about 200 C. The polyester preferably has a lower Tg than the polycarbonate, and acts as a polymeric plasticizer for the polycarbonate. The Tg of the final polyester/polycarbonate blend is preferably between 40 C. and 100 C. Higher Tg polyester and polycarbonate polymers may be useful with added plasticizer. Preferably, lubricants and/or surfactants are added to the dye receiving layer for easier processing and printing. The lubricants can help in polymer extrusion, casting roll release, and printability. Preferably, the polyester dye receiving layer is melt extruded on the outer most surface of the pragmatic sheet.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228. As noted above, dye-donor elements are used to form a dye transfer image. Such a process comprises image-wise-heating a dye-donor element and transferring a dye image to a dye-receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. When the process is only performed for a single color, then a monochrome dye transfer image is obtained.

Thermal printing heads, which can be used to transfer dye from dye-donor elements to receiving elements of the invention, are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise-photodischarge, through analog or digital exposure, of a uniformly charged photoconductor. The photoconductor may be a single-use system, or it may be rechargeable and reimageable, like those based on selenium or organic photoreceptors.

In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

When used as ink jet imaging media, the imaging elements or media typically comprise a coated paper having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The ink receiving layer is preferably coated onto the support layer from water or water-alcohol solutions at a dry thickness ranging from 3 to 75 micrometers, preferably 8 to 50 micrometers.

Any known ink jet receiver layer can be used in combination with the external polyester-based carrier layer of the present invention. For example, the ink receiving layer may consist primarily of inorganic oxide particles such as silicas, modified silicas, clays, aluminas, fusible beads such as beads comprised of thermoplastic or thermosetting polymers, non-fusible organic beads or hydrophilic polymers such as naturally-occurring hydrophilic colloids and gums such as gelatin, albumin, guar, xantham, acacia, chitosan, starches and their derivatives, and the like; derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly(ethylene imine), poly(acrylic acid), poly (methacrylic acid), n-vinyl amides including polyacrylamide and polyvinylpyrrolidone, and poly(vinyl alcohol), its derivatives and copolymers; and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer can be overcoated with an ink-permeable, anti-tack protective layer, such as, for example, a layer comprising a cellulose derivative or a cationically-modified cellulose derivative or mixtures thereof. An especially preferred overcoat is poly β-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water-based inks. The overcoat layer can also protect the ink receiving layer from abrasion, smudging, and water damage. In general, this overcoat layer may be present at a dry thickness of about 0.1 to about 5 $\mu$m, preferably about 0.25 to about 3 $\mu$m.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The layers described above, including the ink receiving layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating, and the like. Some of these methods allow for simultaneous coatings of both layers, which is preferred from a manufacturing economic perspective.

The DRL (dye receiving layer) is coated over the tie layer or TL at a thickness ranging from 0.1–10 $\mu$m, preferably 0.5–5 $\mu$m. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166; 5,264,275; 5,104,730; 4,879,166, and Japanese Patents 1,095,091; 2,276,671; 2,276,670; 4,267,180; 5,024,335; and 5,016,517 disclose aqueous based DRL formulations comprising mixtures of psuedo-bohemite and certain water soluble resins. Light in U.S. Pat. Nos. 4,903,040; 4,930,041; 5,084,338; 5,126,194; 5,126,195; and 5,147,717 disclose aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly(vinyl alcohol). Iqbal in U.S. Pat. No. 5,208,092 discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is 0.1–10 micrometers thick and is coated as an aqueous dispersion of 5 parts alumoxane and 5 parts poly(vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

Smooth opaque bases are useful in combination with silver halide images because the contrast range of the silver halide image is improved and show through of ambient light during image viewing is reduced. The photographic element of this invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100 $\mu$ seconds duration in a pixel-by-pixel mode wherein the silver halide emulsion layer is comprised of silver halide grains is also suitable. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. This invention in a preferred embodiment utilizes a radiation-sensitive emulsion comprised of silver halide grains (a) containing greater than 50 mole percent chloride based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula:

$$[ML_6]^n \quad \text{(I)}$$

wherein n is zero, −1, −2, −3, or −4; M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand; and (ii) an iridium coordination complex containing a thiazole or substituted thiazole ligand. Preferred photographic imaging layer structures are described in EP Publication 1 048 977. The photosensitive imaging layers described therein provide particularly desirable images on the base of this invention.

The invention has been described in detail with particular reference to certain preferred embodiments thereof, but it will be understood that variations and modifications can be effected within the spirit and scope of the invention.

EXAMPLES

Example 1

In this example, an image element of the invention having excellent durability, image structure was created by using a polyolefin coated paper base, and acrylic pressure sensitive adhesive and a composite carrier sheet containing a polyester core with rough surface layer for efficient transport though image printers. This example will show the utility of the invention materials in advertising display and the significant reduction in surface roughness.

Pragmatic sheet;

Paper base was produced using a standard fourdrinier paper machine and a blend of mostly bleached hardwood Kraft fibers. The fiber ratio consisted primarily of bleached poplar (25%) and maple/beech (50%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using an FS-200 Fiber Length Analyzer (Kajaani Automation Inc.). Energy applied to the fibers indicated by the total Specific Net Refining Power (SNRP) was 1.15 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the $3^{rd}$ Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.06. Moisture levels after the calender was 8.4% by weight. The paper base for the pragmatic sheet has a basis weight of 127 g/m$^2$ and thickness of 0.1104 mm.

The paper base was melt extrusion coated on both sides using a typical extrusion grade polyethylene which had a density of 0.925 g/cc and a melt index of 14.0. The polyethylene contained 18% by weight of anatase form of $TiO_2$ with a mean particle size of 0.22 micrometers.

Pressure sensitive adhesive; Permanent solvent based acrylic adhesive 18 $\mu$m thick containing 6% by weight of rutile form of $TiO_2$ with a mean particle size of 0.30 micrometers and 0.20% of tin oxide used for an antistat.

Carrier sheet; The core of the carrier sheet was 140 micrometer thick biaxially oriented polyester containing primer layers of polyethylene amine applied to both sides. Adjacent to the polyethylene amine primer layers was 50 micrometers thick layers of polyethylene. The outermost surface layer of the carrier sheet had a roughness average of 0.38 micrometers and was created by casting the polyethylene against a chilled roller with roughness features with an roughness average of 0.38 micrometers. Opposite the rough polyethylene layer was a layer of UV cured silicone for adhesive release.

Imaging layer; Applied to the outermost surface of the pragmatic sheet was a typical color light sensitive silver halide imaging layers as utilized in photographic color printing papers.

The construction of the imaging element of the invention was as follows;

Light sensitive silver halide imaging layers

Cellulose paper pragmatic sheet

Acrylic pressure sensitive adhesive

Polyester/polyethylene carrier sheet

The resulting imaging element had an overall thickness of 300 micrometers, had a stiffness of 380 millinewtons in the machine direction and a light transmission of 3.8%. The image element was printed, processed, the carrier sheet removed and applied to several different substrates that are commonly utilized in the advertising display industry. The substrates utilized in the example were paper board, acrylic sheets, fabric, glass, velvet, cardboard and wall board. Because the pragmatic sheet of the invention was thick and durable, the roughness of the substrates utilized was reduced by an average of 91% allowing rougher, less expensive materials to be utilized in the display industry. Because the pragmatic sheet was constructed using polyethylene layers, the polyethylene provided a conformable layer allowing improvements over prior art biaxially oriented pragmatic sheets. The rough polyethylene surface layer of the carrier sheet allowed for efficient transport through the photographic printer and processor.

Further, by pressure sensitive laminating the opaque high quality image member of the invention to the above listed substrates, the complexities to printing and processing these substrates materials in a silver halide process are removed. Further, only one opaque imaging member was required to create several differentiated product offerings creating savings for the commercial labs and allowing the commercial lab to utilize silver halide images in a unique fashion. Additionally, the silver halide image layers of the invention have also been optimized to accurately replicate flesh tones, providing superior images of people compared to alternate flexographic printing technologies.

While this example was directed towards silver halide printing of images, other high quality imaging techniques such as ink jet printing, thermal dye transfer printing and electrophotographic printing can be used in combination with the functional bases of the invention to create a new image utility. Further, while this example was directed toward commercial advertising, the invention materials can be used to improve the image utility for consumers and professionals alike. Examples include double sided prints, back illuminated wedding album images, photographic wallpaper and ink jet printed automobile interiors.

What is claimed is:

1. An imaging element comprising an imaging layer, a pragmatic imaging sheet comprising paper having a resin coat on each side, adhesively adhered to a carrier sheet with a pressure-sensitive adhesive, wherein said carrier sheet comprises at least one core layer of polyester and a rough lower back surface layer wherein said back surface has a roughness of between 0.18 and 0.6 micrometers.

2. The imaging element of claim 1 wherein said resin coat on each side of said paper comprises polyethylene.

3. The imaging element of claim 1 wherein said resin coat on each side of said paper comprises polypropylene.

4. The imaging element of claim 1 wherein said rough back surface layer comprises polyethylene.

5. The imaging element of claim 1 wherein said carrier sheet has a stiffness of between 15 and 30 millinewtons in any direction.

6. The imaging element of claim 1 wherein said carrier sheet has a thickness of between 50 micrometers and 100 micrometers.

7. The imaging element of claim 1 wherein the upper surface of said carrier sheet comprises a substantially crosslinked silicone layer.

8. The imaging element of claim 1 wherein the upper surface of said carrier sheet comprises a non-photoactive substantially crosslinked silicone layer.

9. The imaging element of claim 8 wherein said silicone layer has a density stability of 0.03.

10. The imaging element of claim 1 wherein said adhesive has a peel strength of greater than 150 grams per 5 centimeters.

11. The imaging element of claim 1 wherein said adhesive has a peel strength of between 15 and 100 grams per 5 centimeters.

12. The imaging element of claim 1 wherein the peel strength between said pragmatic sheet and said carrier sheet is between 30 and 50 grams per 5 centimeters.

13. The imaging element of claim 1, wherein the peel strength between said pragmatic sheet and said carrier sheet is between 35 and 45 grams per 5 centimeters.

14. The imaging element of claim 1 wherein said carrier sheet has a curl of less than 15 curl units over a temperature range of between 0 to 100° C.

15. The imaging element of claim 1 wherein said adhesive has a resistivity of less than $10^{12}$.

16. The imaging element of claim 1 wherein said adhesive comprises an antioxidant.

17. The imaging element of claim 1 wherein said pragmatic imaging sheet comprises at least one ink jet receiving layer.

18. The imaging element of claim 1 wherein said pragmatic imaging sheet comprises at least one photosensitive silver halide image forming layer.

19. The imaging element of claim 1 wherein said pragmatic imaging sheet comprises at least one thermal dye receiving layer.

20. The imaging element of claim 1 wherein said carrier sheet comprises at least one layer of voided polyester.

21. The imaging element of claim 1 wherein said adhesive comprises pigment.

22. The imaging element of claim 1 wherein said carrier sheet comprises at least one layer comprising a colored pigment.

23. The imaging element of claim 1 wherein said pragmatic imaging sheet has a modulus of greater than 2000 MPa.

24. The imaging element of claim 1 wherein said pragmatic imaging sheet has a modulus between 2000 and 4000 MPa.

25. The imaging element of claim 1 wherein said pragmatic imaging sheet has a thickness of between 400 and 500 micrometers.

26. The imaging element of claim 1 wherein said carrier sheet has a polyethylene layer of both sides.

* * * * *